United States Patent [19]

Margrave et al.

[11] 4,376,563

[45] Mar. 15, 1983

[54] ELECTRICAL CONNECTOR WITH MECHANICALLY ASSISTED LATCH MEANS

[75] Inventors: Shawn G. Margrave, Warren, Ohio; Donald L. Nordeen, Birmingham, Mich.

[73] Assignee: General Motors Corporation, Detroit, Mich.

[21] Appl. No.: 246,079

[22] Filed: Mar. 20, 1981

[51] Int. Cl.[3] ..... H01R 13/627

[52] U.S. Cl. ..... 339/91 R; 339/75 M; 339/94 M; 339/211

[58] Field of Search ..... 339/75 R, 75 M, 75 P, 339/91 R, 94 M, 211

[56] References Cited

U.S. PATENT DOCUMENTS

| | | | |
|---|---|---|---|
| 3,569,909 | 3/1971 | Garver | 339/91 R |
| 3,688,243 | 8/1972 | Yamada et al. | 339/49 R |
| 3,824,525 | 7/1974 | Keller | 339/91 R |
| 3,836,938 | 9/1974 | Barrett, Jr. et al. | 339/45 R |
| 4,010,998 | 3/1977 | Tolnar, Jr. et al. | 339/91 R |
| 4,152,038 | 5/1979 | Inouye et al. | 339/75 M |

*Primary Examiner*—Neil Abrams

*Attorney, Agent, or Firm*—F. J. Fodale

[57] ABSTRACT

An electrical connector has matable dielectric connector bodies which include means for latching the connector bodies in mating engagement. One connector body has a pair of longitudinally spaced catches on one side and a bail wire pivotally mounted on an opposite side. The other connector body has a latch arm pivotally attached to one side and a projecting cam on the opposite side which has a pair of longitudinally spaced notches. The bail wire snap engages a forward notch and the latch arm snap engages one of the catches to retain the connector bodies in a preliminary latched position where the handles of the bail wire and the latch arm are moveable toward each other with one hand. The connector bodies are then mechanically assisted to a fully mated position and latched therein by moving the handles toward each other.

2 Claims, 4 Drawing Figures

ELECTRICAL CONNECTOR WITH MECHANICALLY ASSISTED LATCH MEANS

This invention relates generally to electrical connectors and, more particularly, to electrical connectors comprising mating dielectric connector bodies which are latched together when an electrical connection is made.

It is common to latch connectors bodies together by integral, flexible latch arms on one connector body which snap over and engage integral barbs or catches on the other connector body when the connector bodies are mated. See for instance, U.S. Pat. No. 4,010,998, granted to Emil J. Tolnar et al. on Mar. 8, 1977; U.S. Pat. No. 3,688,243 granted to Shoji Yamada on Aug. 29, 1972 and U.S. Pat. No. 3,569,909 granted to William J. Garver on Mar. 9, 1971.

It is also known to use wire members pivotally mounted on one connector body which co-operate with catches mounted on the other connector body as shown in FIG. 2 of U.S. Pat. No. 3,824,525 granted to Alfred J. Keller on July 16, 1974.

It is also known from U.S. Pat. No. 3,836,938 granted to James H. Barrett, Jr. et al. on Sept. 17, 1974 to use a lever pivotally mounted on one member which has a mechanical advantage for readily breaking electrical connectors.

U.S. Pat. No. 4,152,038 granted to Hiromasa Inouye et al. on May 1, 1979 shows an apparatus which facilitates the coupling and uncoupling of electrical connectors. This apparatus includes operating levers attached to pinions which are sized to provide a mechanical advantage.

The object of this invention is to provide an electrical connector having mechanically assisted latching means which are operable with one hand.

A feature of the invention is that the latching means provide for preliminarily latching the connector bodies in a partially mated position whereupon the latching means can be grasped with one hand to mechanically assist full mating and final latching of the connector bodies.

Other objects and features of the invention will become apparent to those skilled in the art as the disclosure is made in the following detailed description of a preferred embodiment of the invention as illustrated in the accompanying sheets of drawing in which.

Figure 1:
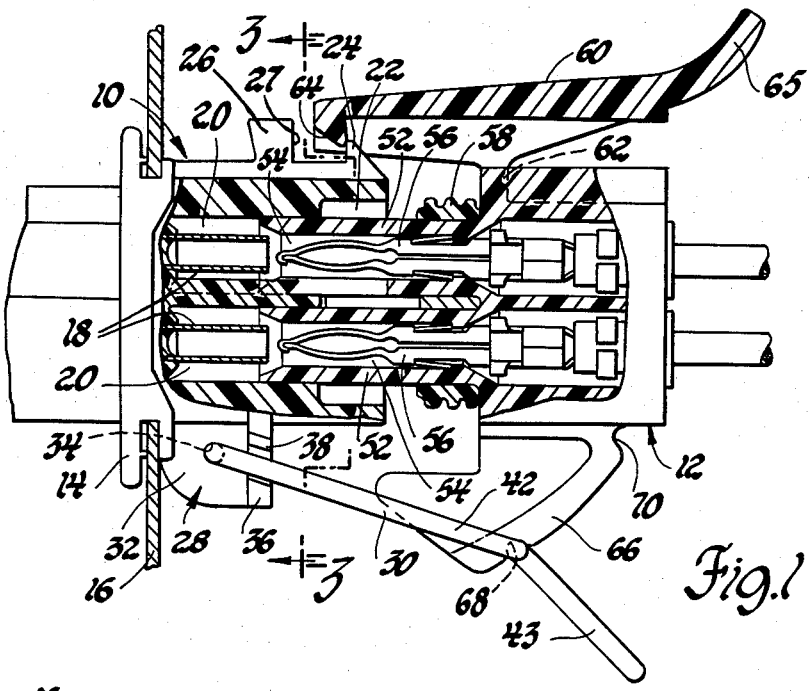
FIG. 1 is a partially sectioned, side view of an in-line electrical connector having a mechanically assisted latch means in accordance with out invention. The connector bodies are shown in a preliminary latched condition.

Referring now to the drawing, FIG. 1 shows an in-line electrical connector comprising mating dielectric connector bodies 10 and 12.

The connector body 10 has a medial, slotted flange 14 by means of which the connector body is mounted on a support panel 16. The connector body 10 is molded of a glass filled polyester or other suitable dielectric material and has four molded-in female terminals 18, each of which project into one of the four oversize cylindrical cavities 20. The cavities 20 in turn open into an enlarged socket 22 at the mating end of the connector body 10.

Figure 3:
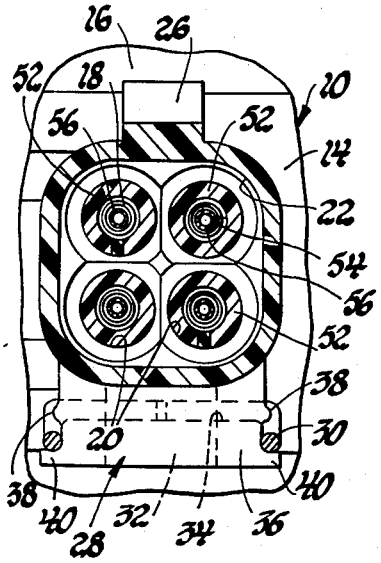
FIG. 3 is a section taken substantially along the line 3—3 of FIG. 1 looking in the direction of the arrows.
Figure 2:
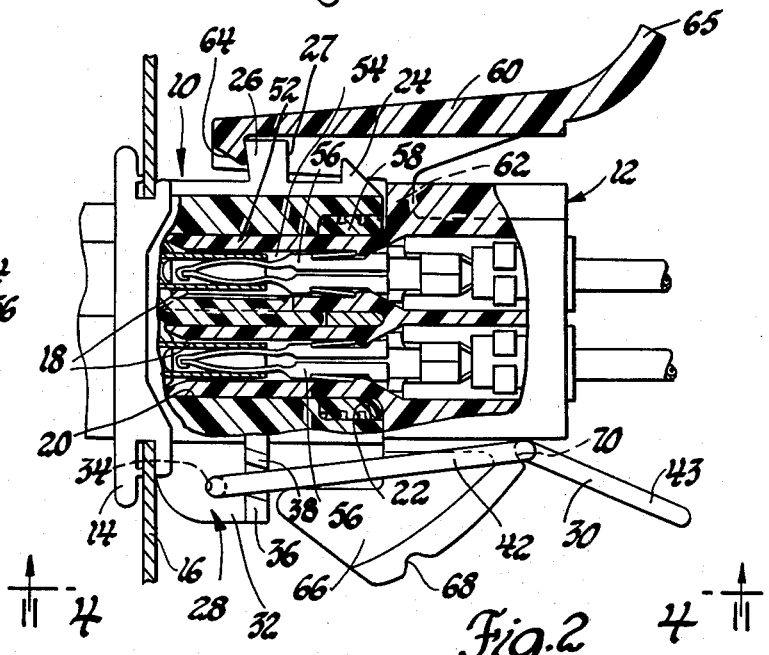
FIG. 2 is a view similar to FIG. 1 showing the connector bodies fully latched.

One side of the connector body 10 (the top side as shown in FIGS. 1, 2 and 3) has two longitudinally spaced barbs or catches 24,26. The opposite side of the connector body 10 has a depending T-shaped support 28 for mounting a bail wire 30.

The support 28 comprises an anchor portion 32 having a through bore 34 and a transverse plate 36. The transverse plate 36 has a medial detent 38 and a lower stop 40 projecting from each side edge.

Figure 4:
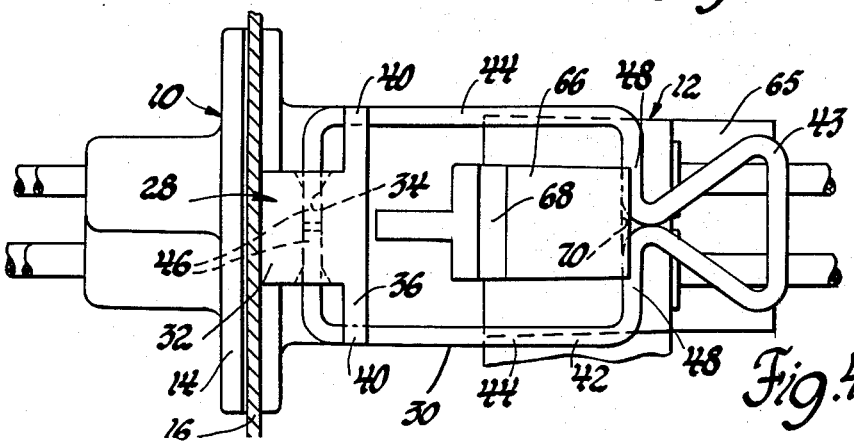
FIG. 4 is a bottom view taken substantially along the line 4—4 of FIG. 2 looking in the direction of the arrows.

The bail wire 30 is formed of a continuous piece of round wire bent to shape a rectangular body 42 and an integral triangular handle 43, as best seen in FIG. 4. The rectangular body 42 comprises spaced side rails 44 and a pair of inwardly bent legs at each end of the side rails. The inwardly bent legs 46 at the end opposite the handle 43 are not connected so that the legs 46 can be spread apart and disposed in the opposite ends of the through bore 34 to pivotally mount the bail wire 30 on the connector body 10.

The inwardly bent legs 48 at the handle end have their inner ends connected to the converging legs of the triangular handle 43 which is canted with respect to the rectangular body 42 as shown in FIGS. 1 and 2. The side rails 44 straddle the plate 36 between the detents 38 and the stops 40 which serve to position the bail wire 30 so that it projects outwardly at an acute angle, toward the socket 22 or mating end as shown in FIG. 1.

The connector body 12 is molded of a dielectric material such as nylon. It has four towers 52 at the mating end which slide into the cavities 20 of the connector body 10. The towers 52 each partly define one of four terminal cavities 54 which contain a male terminal 56. The male terminals 56 mate with the female terminals 18 when the towers 52 are fully inserted into the cavities 20 as shown in FIG. 2. An aperatured elastomeric sealing gasket 58 is snuggly mounted on the inner ends of the towers 52. The sealing gasket 58 has radially sealing lips which engage the socket 22 to seal the interface of the connector bodies 10 and 12 when they are fully mated.

The connector body 12 has an integral latch arm 60 which is attached at its middle to one side (the upper side as shown in FIGS. 1 and 2) of the connector body 12 at pivot portions 62 on each side of the latch arm. The latch arm 60 has a latch 64 at the forward end which co-operates with the catches 24 and 26 and a handle 65 at the opposite end.

The connector body 12 also has a depending cam 66 projecting from its opposite side. The cam 66 which has forward and rearward notches 68,70, cooperates with the bail wire 30 to mechanically assist latching the connector bodies 10 and 12 together.

The connector bodies 10 and 12 are latched together in a two-step process. First, the connector body 12 is inserted partway into the connector body 10 to a preliminary latched position as shown in FIG. 1. As the connector body 12 is inserted to this position, the latch arm 60 snaps over the forward catch 24, but no farther than stop 27, while the bail wire 30, which reacts against the lower stops 40, snaps over the outer end of the cam 66 and into the groove 68. This retains the connector body 12 in the preliminary latched position. In the preliminary latched position, the terminals are not engaged as shown in FIG. 1, so that an electrical connection is not made unless the connector bodies 10 and 12 are fully mated.

The connector body 12 is then grasped with one hand so that the handles 43 and 65 of the latch arm 60 and the bail wire 30 can be squeezed toward each other with a thumb and index finger. As the handles 43 and 65 are squeezed toward each other, the bail wire 30 rides down the cam 66 driving the connector body 12 fully into the connector body 10 while latch arm 60 is lifted and cammed over the catch 26. In the fully mated position, the connector bodies 10 and 12 are securely latched together by the latch arm 60 engaging the catch 26 and the bail wire 30 engaging the notch 70.

We wish it to be understood that we do not desire to be limited to the exact details of construction shown and described, for obvious modifications will occur to a person skilled in the art.

The embodiments of the invention in which an exclusive property or privilege is claimed are defined as follows:

1. In an electrical connector having matable dielectric connector bodies which include means for latching the connector bodies in mating engagement, the combination comprising, a pair of longitudinally spaced catches on one side of one of said connector bodies, a bail wire pivotally mounted on an opposite side of the one connector body, said bail wire being pivotally mounted on said connector body at one end and having a handle at its opposite end, a latch arm pivotally attached at its middle to one side of the other connector body, said latch arm having a latch at one end and a handle at the other end, a projecting cam on the opposite side of said other connector body, said projecting cam having a pair of longitudinally spaced notches, said bail wire snap engaging a forward one of the notches of the projecting cam and said latch arm snap engaging a forward one of the catches when said connector bodies are partially mated to retain the connector bodies in a preliminary latched position where the handles of the bail wire and the latch arm are moveable toward each other with one hand, said connector bodies being mechanically assisted to a fully mated position by the bail wire riding down the projecting cam when said handles are moved toward each other, and said bail wire engaging a rearward one of the notches in the projecting cam and the latch arm engaging a rearward one of the catches to latch the connector bodies in the fully mated position.

2. In an electrical connector having matable dielectric connector bodies which include means for latching the connector bodies in mating engagement, the combination comprising, a pair of longitudinally spaced catches on one side of one of said connector bodies, a bail wire comprising a continuous piece of wire bent to shape a rectangular body having a triangular handle at one end, said rectangular body having inwardly bent legs at the other end which are pivotally mounted on an opposite side of the one connector body, and said one connector having means positioning the bail wire so that it projects outwardly at an acute angle toward a mating end of the one connector body, a latch arm pivotally attached at its middle to one side of the other connector body, said latch arm having a latch at one end and a handle at the other end, a projecting cam on the opposite side of said other connector, said projecting cam having a pair of longitudinally spaced notches, said bail wire having inwardly bent legs adjacent its handle which snap engage a forward one of the notches of the projecting cam and said latch arm snap engaging a forward one of the catches when said connector bodies are partially mated to retain the connector bodies in a preliminary latched position where the handles of the bail wire and the latch arm are moveable toward each other with one hand, said connector bodies being mechanically assisted to the fully mated position by the bail wire riding down the projecting cam when the handles are moved toward each other, and said bail wire engaging a rearward one of the notches in the projecting cam and the latch arm engaging a rearward one of the catches to latch the connector bodies in a fully mated position.

* * * * *